US005603422A

United States Patent [19]

Herrmann

[11] Patent Number: 5,603,422

[45] Date of Patent: Feb. 18, 1997

[54] PLASTIC SAFETY CLOSURE FOR BOTTLES SIMULATING THE APPEARANCE OF A TRADITIONAL CORK-TYPE WINE BOTTLE CLOSURE

[76] Inventor: Ernst Herrmann, CH-9428 Walzenhausen, Switzerland

[21] Appl. No.: 140,133

[22] PCT Filed: Mar. 1, 1993

[86] PCT No.: PCT/CH93/00051

§ 371 Date: Apr. 20, 1994

§ 102(e) Date: Apr. 20, 1994

[87] PCT Pub. No.: WO93/17926

PCT Pub. Date: Sep. 16, 1993

[30] Foreign Application Priority Data

| | | | |
|---|---|---|---|
| Mar. 6, 1992 | [CH] | Switzerland | 726/92 |
| Oct. 19, 1992 | [CH] | Switzerland | 3238/92 |
| Feb. 23, 1993 | [CH] | Switzerland | 551/93 |

[51] Int. Cl.[6] ..... B65D 41/34

[52] U.S. Cl. ..... 215/256; 215/250; 215/252; 215/253; 215/254; 206/807; 220/281

[58] Field of Search ..... 215/252–256, 215/257, 250; 206/807, 497; 220/266, 269, 281

[56] References Cited

U.S. PATENT DOCUMENTS

| | | | |
|---|---|---|---|
| 2,130,609 | 9/1938 | Alexander | 215/254 |
| 3,032,226 | 5/1962 | Terwilliger | 215/256 |
| 3,335,889 | 8/1967 | Brumme | 215/252 |
| 3,348,718 | 10/1967 | Musy | 215/252 |
| 3,684,118 | 8/1972 | Brumme | 215/256 X |
| 3,746,201 | 7/1973 | Fujia | 215/254 X |
| 3,924,771 | 12/1975 | Cleff | 215/256 X |
| 4,279,350 | 7/1981 | King | 215/261 X |
| 4,474,302 | 10/1984 | Goldberg et al. . | |
| 4,483,450 | 11/1984 | Sanchez | 215/254 |
| 4,553,682 | 11/1985 | Tsurumaru et al. | 22/266 X |
| 4,573,582 | 3/1986 | Kusz | 215/232 X |
| 4,596,338 | 6/1986 | Yousif | 215/261 X |
| 4,648,519 | 3/1987 | Kennedy | 215/261 |
| 4,666,052 | 5/1987 | Ou-Yang . | |
| 4,778,698 | 10/1988 | Du-Yang | 215/347 X |
| 5,031,787 | 7/1991 | Ochs | 215/350 X |
| 5,096,084 | 3/1992 | Wells | 220/326 X |
| 5,190,178 | 3/1993 | Luch | 215/256 |

FOREIGN PATENT DOCUMENTS

| | | |
|---|---|---|
| 40135/58 | 8/1958 | Australia . |
| 9204/66 | 8/1966 | Australia . |
| 28134/67 | 10/1967 | Australia . |
| 81907/75 | 6/1975 | Australia . |
| 15466/76 | 1/1978 | Australia . |
| 22104/83 | 6/1984 | Australia . |
| 59896/86 | 9/1988 | Australia . |
| 556849 | 5/1957 | Belgium . |
| 742359 | 5/1970 | Belgium . |
| 0395212 | 10/1990 | European Pat. Off. . |
| 713325 | 10/1931 | France . |
| 1462219 | 11/1966 | France . |
| 619169 | 9/1935 | Germany . |
| 1482594 | 1/1969 | Germany . |
| 2454273 | 5/1975 | Germany . |
| 628172 | 11/1961 | Italy . |
| 6409078 | 2/1965 | Netherlands . |
| 1140840 | 1/1969 | United Kingdom . |
| 2039817 | 8/1980 | United Kingdom . |
| WO92/13773 | 8/1992 | WIPO . |

*Primary Examiner*—Allan N. Shoap
*Assistant Examiner*—Robin A. Hylton
*Attorney, Agent, or Firm*—Young & Thompson

[57] ABSTRACT

A closure for wine bottles comprising a rigid head 1 and a tear-off safety portion 10, 11. The tear-off portion 10, 11 is in the form of a skirt having an upper ring 10 and a lower truncated conical portion 11 narrowing in the direction of the ring 10. This ring 10 is connected to the head 1 of the closure by a tear-off zone 17 and a generatrix of the skirt 11 is provided with a tearing off portion 33.

22 Claims, 4 Drawing Sheets

PLASTIC SAFETY CLOSURE FOR BOTTLES SIMULATING THE APPEARANCE OF A TRADITIONAL CORK-TYPE WINE BOTTLE CLOSURE

BACKGROUND OF THE INVENTION

1. Field of the Invention

The present invention concerns a safety closure of plastic material, namely a closure which will not permit the opening of the receptacle that it closes without this opening being made detectable, for example, by tearing or the separation of a portion of this closure.

The present invention relates more particularly, but not exclusively, to a safety closure adapted to close wine bottles.

2. Description of Related Art

Traditionally, wine bottles are closed by corks, then wrapped, these wrappings totally enclosing the top of the bottle and extending for several centimeters along the neck of the bottle. These wrappings are generally of colored tin or provided with inscriptions or decorations.

Good quality cork is becoming more and more scarce and more and more expensive, and therefore metal screw closures have been provided for bottles of wine. These closures comprise a ring of low height, two to three millimeters, pinched in below the rim on the neck of the bottle and a pre-weakened rupture line permitting separating this ring of the closure during its unscrewing, thus ensuring the safety function of being able to detect when the bottle has been opened. These metallic closures comprise a sealing gasket of plastic material or cardboard covered with a metal sheet, generally of aluminum, and are completely satisfactory at least for white wines.

These metallic closures nevertheless have substantial drawbacks which are:

- not giving to the closed bottle the appearance of a traditional bottle whose neck is covered by wrapping for three to four centimeters.
- complicating or even preventing the recycling of empty bottles because the metallic ring which detaches from the closure during unscrewing remains on the neck of the bottle and can be removed only with great difficulty.

SUMMARY OF THE INVENTION

The object of the present invention is the provision of a safety closure, particularly for the closure of wine bottles, permitting the replacement of cork and giving to the closed bottle the traditional appearance while avoiding during its opening leaving a part of the closure fixed to the neck of the bottle.

The present invention has for its object a safety closure, particularly for wine bottles, that overcomes the above drawbacks and that comprises the characteristics recited in claim 1.

BRIEF DESCRIPTION OF THE DRAWING

The accompanying drawings illustrate schematically and by way of example several embodiments of closures according to the present invention.

DETAILED DESCRIPTION OF PREFERRED EMBODIMENTS

Figure 1:
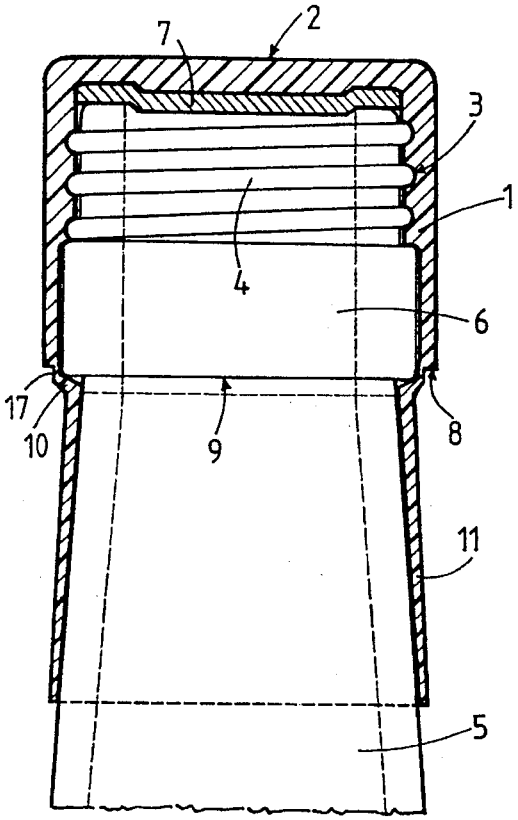
FIG. 1 is an axial cross section of a first embodiment of a closure in service position closing a bottle.
Figure 2:
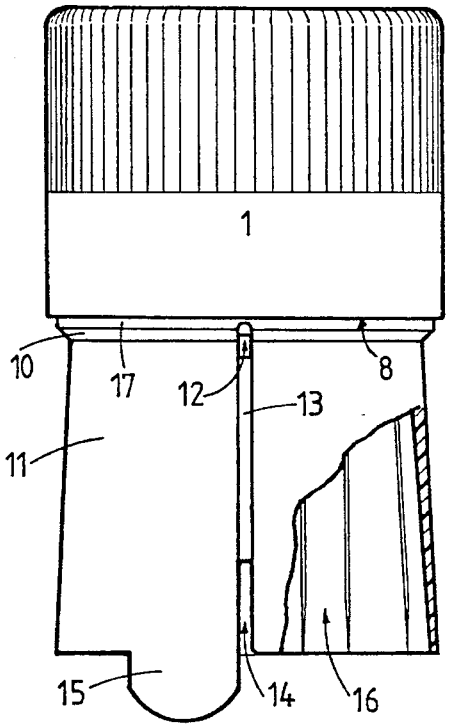
FIG. 2 is an elevational view of the closure shown in FIG. 1.
Figure 3:
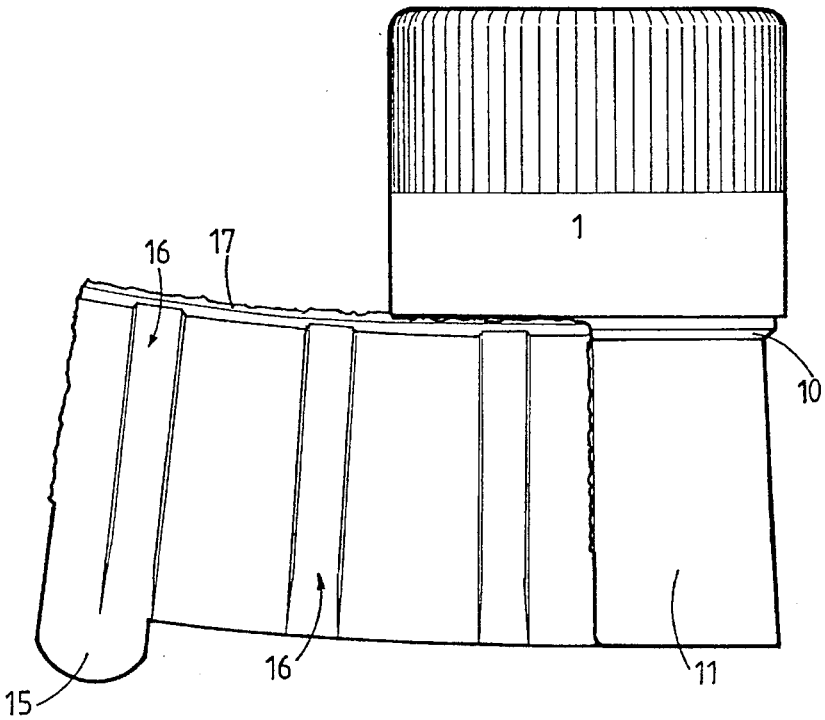
FIG. 3 is an elevational view of the closure shown in FIGS. 1 and 2, its skirt being partially torn off.

The safety closure for bottles with screw threads, and particularly for bottles of wine, as shown in FIGS. 1–2, is injection molded from plastic material, generally food quality polyethylene.

This closure comprises a rigid head 1 which can be provided on its periphery with ribs or other formations facilitating its gripping and its rotation. The internal cylindrical surface of this head is provided adjacent its top surface 2, with a screw-thread 3 adapted to coact with a screw head 4 carried by the external surface of the neck 5 of the bottle. The internal surface of this head closely matches the external surface of the neck down to the lower edge of its cylindrical bulge 6.

The inside top surface of the head 1 receives a sealing gasket 7 constituted by a ring of compressible plastic material covered on at least its exposed surface with a metallic sheet, generally a sheet of aluminum. The exposed surface of this sheet or these metallic sheets can be covered with a film of plastic material, on a metalized plastic sheet or a plastic sheet, generally a tinned plastic sheet, generally of PET. This gasket 7 is maintained in position between the inside top surface of the head 1, whose thickness is slightly greater at the center than at the periphery, and the screwthread 3 of the head.

The internal surface of the top of the head can have a circular rib, of a diameter less than the internal diameter of the head, permitting in screwed service position to apply the gasket forcibly against the neck of the bottle, this gasket then matching the shape of the upper free surface of this neck.

The lowermost part of the screw-thread 3 constitutes an axial abutment defining the screwed position of the closure on the bottle, which axial abutment in the closed position comes into contact with the upper portion of the bulge 6 of the neck.

The distance separating the inside top surface of the head from the lowermost part of the screw-thread 3 corresponds to the thickness of the gasket 7 in its compressed condition increased by the distance separating the free end of the neck 5 from the upper portion of its bulge 6. When the closure is thus screwed down onto the neck, the gasket 7 is sufficiently compressed and deformed to ensure complete sealing of the bottle.

In service position screwed on the neck 5 of a bottle, the lower edge 8 of the head 1 of the closure is located substantially in the plane containing the lower surface 9 of the cylindrical bulge 6 of the bottle.

The closure according to the invention also comprises a neck or skirt comprising an upper ring 10 whose internal diameter is less than that of the flange 8 of the head 1, and thus less than the external diameter of the bulge 6 of the neck. This ring 10, generally of a truncated conical shape opening in the direction of the head 1 of the closure, is integral with a truncated conical wall 11 opening in the direction opposite to the head 1 of the closure. This truncated conical wall 11 closely matches the part of the neck 5 of the bottle located just below the bulge 6 and extends for two or three centimeters or more as needed, particularly for appearance.

The neck or skirt formed by the ring 10 and the truncated conical wall 11 is connected to the head 1 of the closure by a thin web or membrane 17 of plastic material of a thickness of about 0.2 to 0.4 mm, preferably 0.3 mm, while the rest of the skirt has a thickness on the order of 1 mm and the lower edge 8 of the head 1 has a thickness generally greater than 1 mm.

As shown in FIG. 2, the skirt has on its periphery an opening 12 completely or partially sectioning at least the ring 10 and thus creating a tear line, which, as will be seen later, will permit separating the ring 10, and hence the safety skirt 11, from the head of the closure.

On the same generatrix as the opening 12, the skirt has a decreased thickness of about 0.3 mm constituting a tear-line 13 extending over a distance less than the height of the skirt. This portion 13 of lesser thickness is followed, still on the same generatrix of the skirt, by a slot 14 constituting a total sectioning of the skirt to its lower open end.

The bottom of the skirt, or of the truncated conical wall 11, comprises a tear-tab 15 situated immediately adjacent to the slot 14. For a closure screwing on normally in a clockwise direction, this tear-tab 15 is located to the left of the slot 14. It would be located on the other side of the slot 14 for a closure of opposite threading.

Generally, such a closure is produced by injection of plastic into a mold comprising a core having the shape of the neck of the bottle. It is therefore necessary to obtain demolding of the closure which will not involve tearing of the skirt, the skirt having a certain elasticity letting it stretch to clear the portion of greatest diameter of this core. This can be obtained if desired by demolding at a certain temperature permitting this stretching. However, such a solution is not satisfactory because it is then necessary during closure of the bottles that this skirt will stretch elastically to pass below the bulge 6 of the neck 5 and that it then shrinks to match closely this neck and that the ring 10 locks the closure on the bottle by bearing against the overall surface of the bulge 6. It is necessary that this fitting of the closure takes place without tearing of the thin web or membrane 10 connecting the head 1 to the skirt.

To obtain sufficient radial elasticity of the skin, the latter comprises over all or a portion of its height at least two or three, but preferably six or more, longitudinal regions 16 of a thickness reduced to about 0.3–0.4 mm. The external surface of the skin is smooth, while its internal surface is thus channeled. These channelings are, however, invisible from outside the closure, the pigmentation and the coloration of the plastic material being sufficient.

Thus, thanks to these channels or portions of reduced thickness of the skirt, there is conferred on the latter the radial elasticity sufficient that it can expand, and particularly such that the ring 10 expands during fitting of the closure on a bottle without the film or membrane connecting the ring 10 to the edge 8 of the head 10 becoming damaged. Moreover it is not possible simply to decrease uniformly the thickness of the skin to confer the necessary radial elasticity because, to separate the closure from the core during fabrication, it is necessary not only to pull on the head, but also to push the skin by its lower portion to prevent it from separating from the head. This skirt must thus have high rigidity in the axial direction.

To obtain the necessary elasticity of the skin, given the material used and the difference in diameter between the external surface of the bulge 6 and of the adjacent portion of the neck of the bottle, one can change the number and size of these zones of reduced thickness 16. To obtain the same elasticity, the greater the number of zones 16, the more their width should be reduced, and vice versa.

To fit the closure on the bottle, the closure is axially fitted over the neck of the bottle until the bulge 6 of the bottle snaps over the ring 10 of the closure and the screw threads of the bottle and of the closure touch, then the closure is screwed on, which compresses the gasket 7 and therefore effects hermetic sealing of the bottle and simultaneously the retraction of the ring 10 below the enlargement 6 of the neck preventing any unscrewing of the closure without damaging it.

This closure thus permits effecting sealed closing of the bottle, guaranteeing its integrity because it is not possible to remove the closure without damaging it. Moreover, this closure of plastic material is hygienic and advantageously replaces cork even as to the organoleptic qualities of the wine. Finally, thanks to the skirt 10, 11, the external appearance of the closed bottle is that of a traditional bottle.

To remove the closure, it suffices to pull on the tab 15 so as to rupture the skirt along the slot 14 and into the scoring 13, then to separate the skirt from the head by tearing off the membrane connecting the ring 10 to the head 1.

It will e noted that upon pulling on the tab 15 to effect the separation of the skirt from the head, the closure is not unscrewed, on the contrary it is screwed on more tightly by this action.

Then, the skirt being separated from the head, the closure can be unscrewed and of course re-screwed for closing the bottle temporarily if necessary.

This closure therefore has also the advantages of leaving nothing about the neck upon opening, the skirt being torn off and separated from the closure and from the bottle which permits recycling of this bottle. Finally, the head of the closure can be used to reclose the bottle.

The plastic material of the closure can, of course be tinted white or red throughout its thickness as with conventional tin closures. These closures can also be printed, by serigraphy or typography, so to impart thereto decoration or the name of the proprietor or of the wine dealer.

This closure therefore provides for the first time an ecologically sound alternative, a good appearance to the bottle, and organoleptic similarity to conventional corks and tin caps.

In a modification, the head of the closure need not have screwthreads and could be used with bottles having no screw-threads. The maintenance of the closure on the bottle is then ensured only by the ring 10 which during closure is fitted below the bulge 6 of the bottle.

Figure 4:
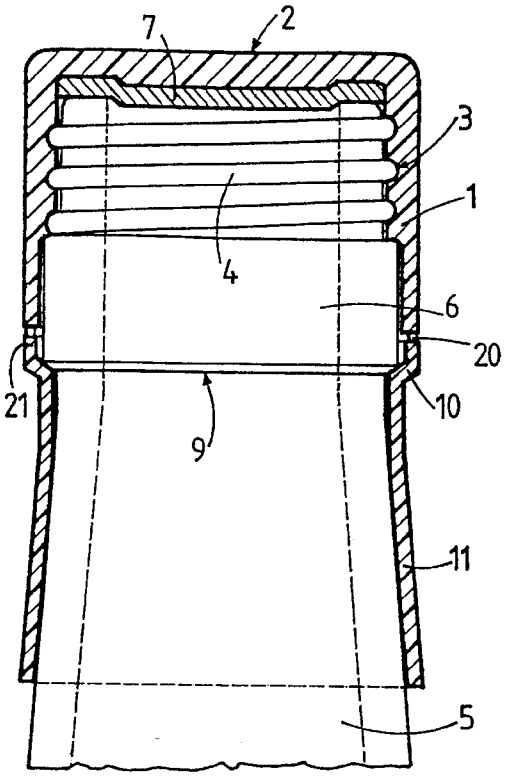
FIGS. 4–6 are views similar to FIGS. 1–3 of a second embodiment of the closure.
Figure 5:
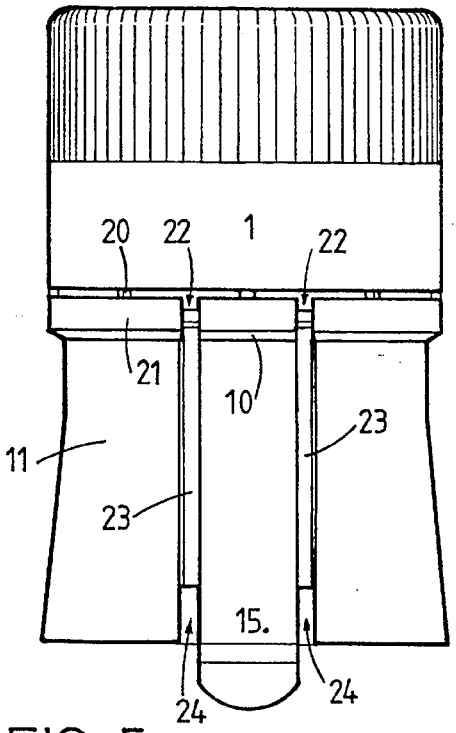
Figure 6:
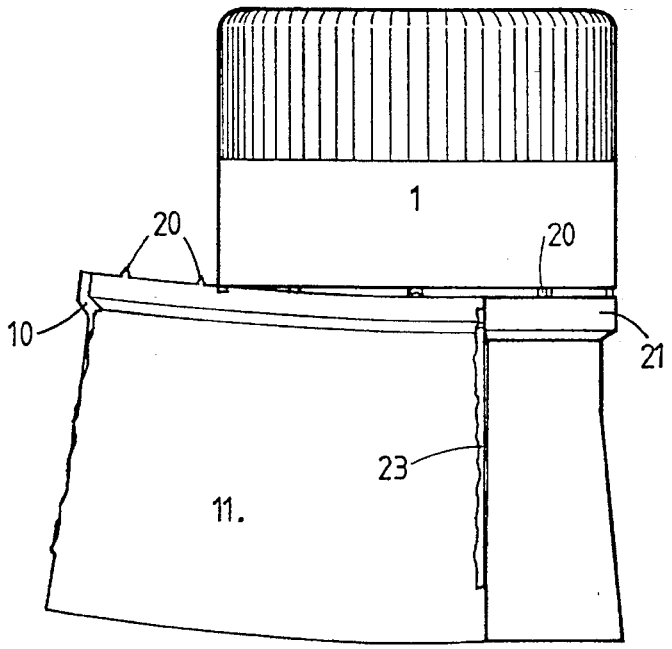

FIGS. 4–6 show a second embodiment of closure according to the invention. In this embodiment the closure again comprises the head 1 whose inside top surface 2 is provided with a gasket 7 and whose internal wall is provided with threading 3. This head 1 is connected to a detachable portion constituted by a ring 10 and a skirt 11, both truncated conical but in opposite directions as in the first embodiment.

In this second embodiment, the tearable zone connecting the head 1 to the tear-off portion 10, 11 is constituted either by a perforated zone, or by bridges 20 connecting the ring 10 via a collarette 21 formed with the ring 10 and of the same external diameter as the lower portion of head 1.

Thanks to this tear-off region formed by perforations or bridges 20, the head 1 of the closure can be separated from the rest by unscrewing, giving rise to breakage of the bridges 20.

In this embodiment, the tear tab 15 is situated between two points each constituted by an opening 22 at least partially dividing the ring 10, a zone of reduced thickness 23 aligned along the generatrix comprising the corresponding opening 22, zone 23 ending in a slot 24.

In this embodiment, the internal walls of the skirt 11 and of the ring 10 are smooth and of substantially constant thickness. The radial elasticity of the ring 10 and of the skirt 11 necessary to demold the closure during its fabrication and thereafter to fit it on a bottle is obtained in this case only by the two beginning points of tearing 22, 23, 24 disposed on each side of the tab 15.

The inclination of the internal surface of the ring 10 is such that the axial force necessary to begin its elastic removal is greater than the force at which the bridges 20 rupture. Thus, the closure is indeed a safety closure, as its opening whether by unscrewing the head 10 and rupturing the bridges 20 or by tearing the tab 15 and separating the skirt and the ring from the head, causes in any case a separation between its skirt and its head.

This embodiment of the closure has the advantage of permitting its opening in two ways and still permitting the removal of the skirt from the bottle neck without a tool, by simple tearing off of the tab 15.

In a modification, the zones of reduced thickness 23 of the beginning point of tearing of the skirt can comprise perforations. Generally the resistance to tearing of the zone of least thickness of the beginning point of rupture increases upwardly form the skirt to the ring. This permits obtaining both easy tearing off of the tab to open the skirt and good securement of the closure on the neck of a bottle immediately after its fitting.

It will be evident that according to the elasticity of the plastic material used for the production of the closure, and if the zones 23 do not suffice to give the requisite radial elasticity, local thinning of the skirt 11 and of the ring 10 can be provided as in the first embodiment described above.

It will be evident that these local thinnings of the skirt 11 and/or of the ring 10 could open not only as shown on the internal surface of the skirt, but on the external surface thereof.

In a modification, there could be provided in a manner know per se one or several driving formations integral with the head connecting with openings in the skirt. Each drive formation and its corresponding opening has a straight driving side, extending approximately along a generatrix of the closure and an oblique side, forming an angle relative to a generatrix of the closure.

Figure 7:
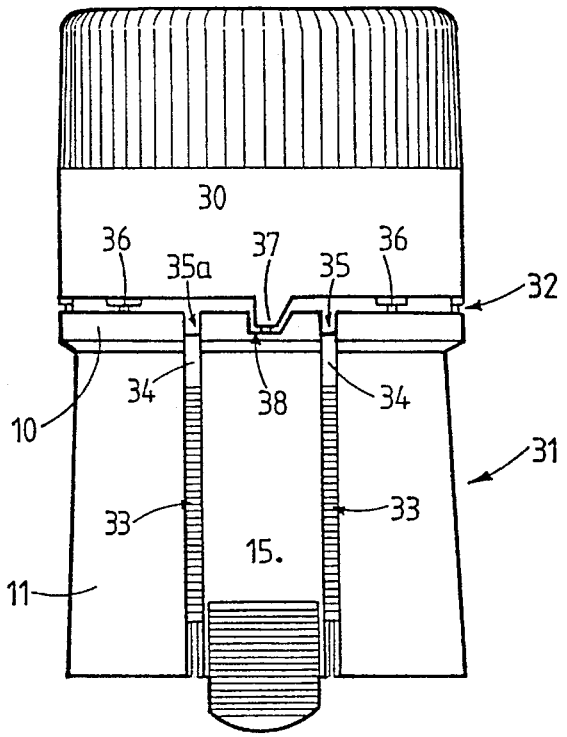
FIGS. 7 and 8 show a practical form of execution of the closure according to the invention.
Figure 8:
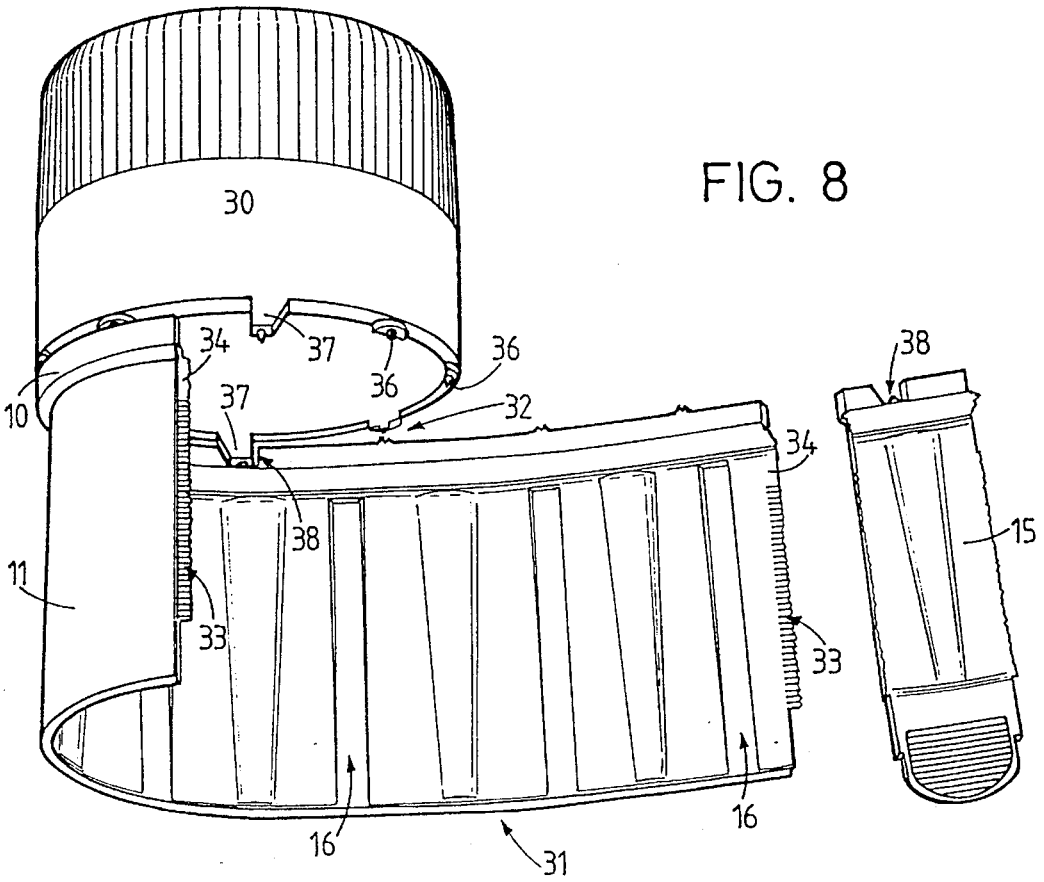

FIGS. 7 and 8 show the practical embodiment of the closure according to the invention comprising a rigid head 30 connected to a separable portion 31 by a tear-off safety zone 32. The separable portion is formed as described above by the skirt having a ring 10 and a lower portion 11. The separable portion 31 comprises also a tab 15 for opening said skirt connected to the skirt by points of beginning tear provided with preperforations 33 terminating in the direction of the ring 10 at a thicker plane portion 34. The ring 10 itself is interrupted at points 35*a* in the direction of these beginning points of rupture.

The connection between the head 30 and the skirt 31 is effected by separate bridges 36 constituting the tear-off safety zone.

In this embodiment, there will be seen the formations for driving and the rotation of the skirt 31 by the head, for its screwing onto a bottle; corresponding male formations 37 and female formations 38 comprising respective portions of the head and of the skirt.

Otherwise this embodiment comprises the same principal characteristics as described with respect to the preceding embodiments.

In this modification, the sealing gasket 7 placed at the inside top surface of the rigid head 30 comprises one or several perforations of small diameter disposed in a central region having a diameter of about 14 mm. These perforations are to prevent outflow of liquid contained in the bottle but permit gas exchange, of air or oxygen, by passage between the contents of the bottle and the exterior on the one hand through these perforations and then by diffusion through the material of the top of the head 30. This is particularly useful for the bottling of red wines whose long-life organoleptic properties must still evolve after bottling by slow and controlled contact with the ambient air outside the closed bottle, as is the case with corks.

In the case where the bottles are recovered, cleaned and prepared for their filling automatically it is possible to provide a working station having a tool enabling to cut or take off the skirt of the closure which remains on the collar of the bottle. In such case, it is no more necessary for said skirt to be provided with longitudinal tearing off means or beginning of rupture nor with a tag.

Figure 9:
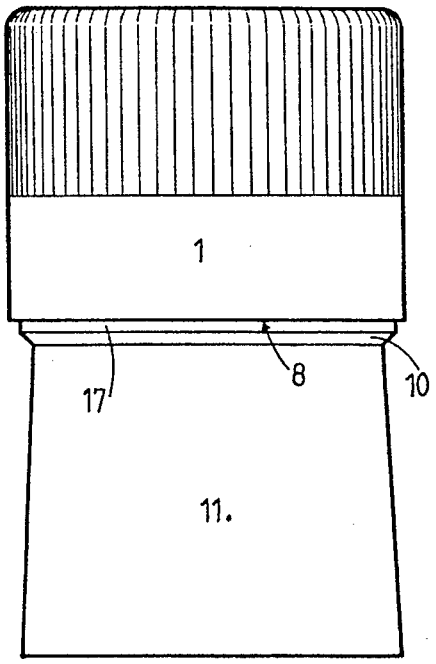
FIG. 9 shows a variant of the closure in which the skirt is not provided with longitudinal tearing-off means.

Then in a variant the safety plastic closure according to the invention, as shown in FIG. 9, for wine bottles particularly, comprises in combination a rigid head connected to a removable portion through a safety or guarantee tearing off zone. This separable portion has the shape of a skirt having an upper ring and a lower truncated conical position of a height which is greater than that of the head, the said tearing off zone connecting said head to said ring. It is evident that in this variant the skirt and the ring forming the part, separable from the head of the closure, can show all the particular characteristics, e.g. length, shape and inside notches etc. as described previously except for the longitudinal tearing off means at point of rupture and for the tag.

In all embodiments of the closure the height of the truncated conical skirt is always greater than the height of the head of the closure.

In another variant of the closure it can be provided, as in the first embodiment, with a skirt having a longitudinal tearing off means or beginning of rupture, but the lug 15 would be omitted to improve the aesthetical outlook of the closure.

Figure 10:
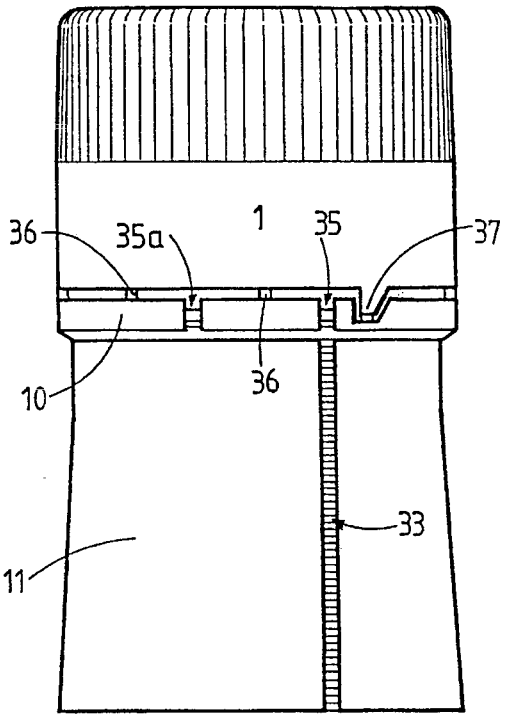
FIG. 10 shows a variant of the closure comprising tearing-off means on the skirt.

In this case, as shown in FIG. 10, the tearing-off means comprise an opening 35, as in the embodiment of FIG. 7, cutting the ring 10 and a preperforated line 33 extending along the whole length of the skirt 11.

Figure 11:
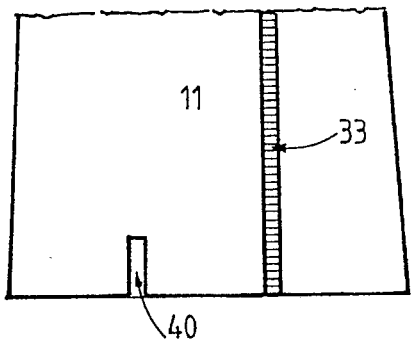
FIGS. 11 and 12 are detail views of skirt variants.

In a variant shown at FIG. 11, the closure shown at FIG. 10 has a slot 40 near the pre-perforated line 33, the two defining a pseudo-lug permitting the manual tearing off of the skirt by rupture along said preperforated line 33.

In another variant, the pre-cut could be constituted only by a slot 40, the remainder of the skirt being plain and smooth outside as inside.

Figure 12:
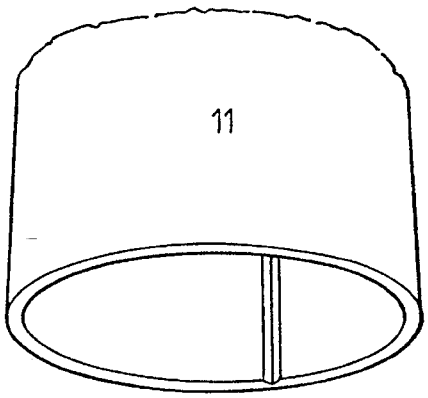

FIG. 12 shows a variant of the skirt 11 of the closure in which the pre-cut is constituted by a V-shaped groove opening on the internal surface of the skirt. This pre-cut is invisible form the outside of the skirt and improves the appearance of the closure.

Practice has shown that when the thickness of the skirt is on the order of 0.3 to 0.6 mm it is not necessary to provide for inside longitudinal grooves or ribs, the resiliency of the skirt, even without pre-cut and without grooves, being sufficient to fit the closure on a bottle.

In all these embodiments when the skirt 11 has a pre-cut, or when said skirt is thin enough, i.e. of the thickness less than 0.8 mm, it is possible, after having unscrewed and removed the head of the closure, to separate the skirt form the bottle either manually or automatically through a relative axial displacement of this skirt with respect to the bottle towards the bottom of the bottle.

In fact, due to the presence of the ring 10 which is rigid, it is possible by means of a tubular tool slid over the neck of the bottle and resting against this ring 10 to cause a relative axial displacement of the skirt with respect to the bottle. As the diameter of the bottle increases from its neck towards its body, the relative displacement causes the splitting, the opening or the tearing off of the skirt which can then easily be separated from the bottle. Such a tubular tool can be actuated manually or automatically in a working station of a bottle washing installation. To facilitate the opening of the skirt, it can have a pre-cut such as above described or simply a slot or opening in a small length merging out on its lower edge, for example the slot 40 (FIG. 11).

Finally, it has to be mentioned that such a closure, which weighs about 5.5 g, shows an ecological and energetical balance which is extremely favorable, up to ten times between than a conventional closure made of aluminum of the type of Alu (W-Welt) for example. Tests made by BASF AG Kunstoffe und Umwelt, Dr. K-H Feuerherd, 10.02.93 have indicated the following comparative values for the closure according to the invention (LD-PE) and to aluminum closure marketed under the name of Aclu (W-Welt).

| For 1,000 pieces | LD-PE | Aclu (W-Welt) |
|---|---|---|
| Energy MJ | 260.70 | 479.36 |
| Air $dam^3$ | 1,271.51 | 11,335.68 |
| Water $dm^3$ | 590.15 | 1,792.84 |
| Storage $cm^3$ | 1,610.40 | 5,328.12 |

In all embodiments the closure comprises a head screwed on a neck of a bottle, connected by a safety zone which is tearable of a skirt. This skirt comprises a rigid ring connected to the head of the tearing-off zone and a frusto-conical portion fitting the neck of the bottle and having a height greater than that of the head. This skirt may be separated from the neck of the bottle, after having unscrewed the head, either manually or by means of a tool permitting the skirt to slide along the neck of the bottle downwardly and causing the splitting of the skirt by an increase of its diameter. The skirt comprises preferably a pre-cut which in its simplest realization can be made as a slot or an opening in its wall having a small length and opening on its lower edge. It is also possible to have two adjacent slots to create a tearing-off tag.

What is claimed is:

1. A safety closure of molded synthetic material, comprising a rigid head having interior screw threading, a separable portion connected to the rigid head by a circular tear-off safety zone, said separable portion comprising an upper ring and a lower skirt, the skirt having a truncated conical shape narrowing in the direction of the ring, the separable portion comprising opening means for breaking said portion in a substantially longitudinal direction, wherein said opening means comprises an opening formed through said upper ring below said circular tear-off safety zone, and a longitudinally extending portion of reduced thickness extending from said opening, and a slot connecting said portion of reduced thickness to a lower edge of said lower skirt, said opening and said longitudinally extending portion and said slot being in alignment along a single straight line.

2. A closure according to claim 1, further comprising a sealing gasket disposed at an inside top surface of said rigid head, said gasket being formed by a circular piece of deformable synthetic material covered on its exposed surface with a sheet of plastic material.

3. A closure according to claim 2, wherein said plastic sheet is covered with a film of synthetic PET material.

4. A closure according to claim 1, wherein said opening means comprises a tear-tab extending longitudinally of said lower skirt and having a tab portion projecting downwardly beyond a lowermost edge of said lower skirt.

5. A closure according to claim 4, wherein regions of reduced tear strength are provided on both sides of said tear-tab.

6. A closure according to claim 1, wherein said tear-off safety zone comprises a membrane whose thickness is substantially less than that of said upper ring.

7. A closure according to claim 1, wherein said tear-off safety zone is a circular perforated region.

8. A closure according to claim 1, wherein said tear-off safety zone comprises separate bridges distributed about the circumference of said safety zone, and connecting said rigid head to said upper ring.

9. A closure according to claim 1, wherein said lower skirt comprises longitudinally-extending regions of reduced thickness, thereby to impart radial elasticity to said lower skirt.

10. A closure according to claim 9, wherein said lower skirt has a thickness of 0.8 to 1.2 mm, and wherein said regions of reduced thickness have a thickness of 0.2 to 0.4 mm.

11. A closure according to claim 1, wherein said lower skirt has a longitudinal extent in excess of 2 cm.

12. A closure according to claim 1, wherein said closure is formed of tinted food quality polyethylene.

13. A closure according to claim 1, wherein said rigid head comprises exterior formations facilitating its grasping and rotation.

14. A closure according to claim 1, wherein said closure has a smallest internal diameter at a junction of said upper ring and said lower skirt.

15. A closure according to claim 14, wherein said upper ring has a truncated conical shape which opens toward said rigid head.

16. A closure according to claim 1, wherein said longitudinally extending region of reduced thickness is connected to said upper ring by a longitudinally extending region of relatively greater thickness.

17. A closure according to claim 1, wherein said longitudinally-extending region of reduced thickness has progressively increasing resistance to tearing in a direction from a lowermost edge of said lower skirt to said upper ring.

18. A closure according to claim 1, wherein said rigid head comprises an interior circular rib of diameter less than an internal diameter of said rigid head.

19. A closure according to claim 1, wherein said rigid head comprises at least one downwardly-extending drive formation formed at its lower edge and extending into an opening formed on said upper ring, said at least one drive formation and said opening having a straight drive side extending substantially axially of said closure, and an oblique side.

20. A closure according to claim 1, wherein said portion of reduced thickness is formed as a V-shaped groove opening interiorly of said lower skirt.

21. A closure according to claim 1, wherein said lower skirt has a smooth internal wall and a thickness of less than 0.7 mm.

22. A closure according to claim 1, wherein said longitudinally extending portion of reduced thickness includes perforations.

* * * * *